United States Patent [19]

Kraic

[11] Patent Number: 4,772,191

[45] Date of Patent: Sep. 20, 1988

[54] INTERNALLY AXED SINGLE-ROTATION MACHINE WITH SEALING GAP ARRANGEMENT

[75] Inventor: Otto Kraic, Lindau, Fed. Rep. of Germany

[73] Assignee: Felix Wankel, Lindau, Fed. Rep. of Germany

[21] Appl. No.: 902,145

[22] Filed: Aug. 29, 1986

[30] Foreign Application Priority Data

Aug. 31, 1985 [CH] Switzerland ..... 03742/85

[51] Int. Cl.[4] ..... F01C 1/10; F01C 19/00; F01C 21/08

[52] U.S. Cl. ..... 418/168

[58] Field of Search ..... 418/150, 166, 168, 171

[56] References Cited

U.S. PATENT DOCUMENTS 3,029,738 4/1962 Clar ..... 418/168
3,275,225 9/1966 Schultz ..... 418/150
4,028,023 6/1977 Labus ..... 418/168

FOREIGN PATENT DOCUMENTS 2058860 2/1983 Fed. Rep. of Germany ..... 418/168
3432915 12/1985 Fed. Rep. of Germany ..... 418/166
316295 5/1930 United Kingdom ..... 418/166

*Primary Examiner*—John J. Vrablik
*Attorney, Agent, or Firm*—Ladas & Parry

[57] ABSTRACT

For an improved sealing at the sealing gaps of a single-rotation machine having internal axes and accompanied by minimum frictionally losses, the width of the sealing gaps is made to differ in such a way that the narrower sealing gaps occur on the radially outer circumferential surfaces of the internal rotor facing the engagement parts of the external rotor. The comparatively wider sealing gaps occur on the transition surfaces between radially inner circumferential surfaces and radially outer circumferential surfaces of the internal rotor.

7 Claims, 4 Drawing Sheets

FIG. 1
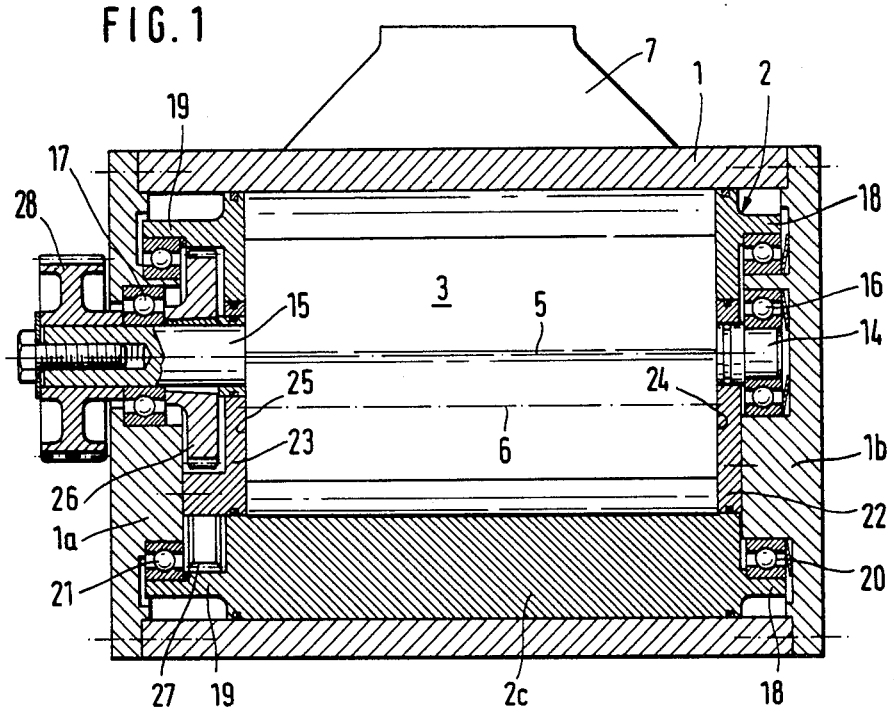
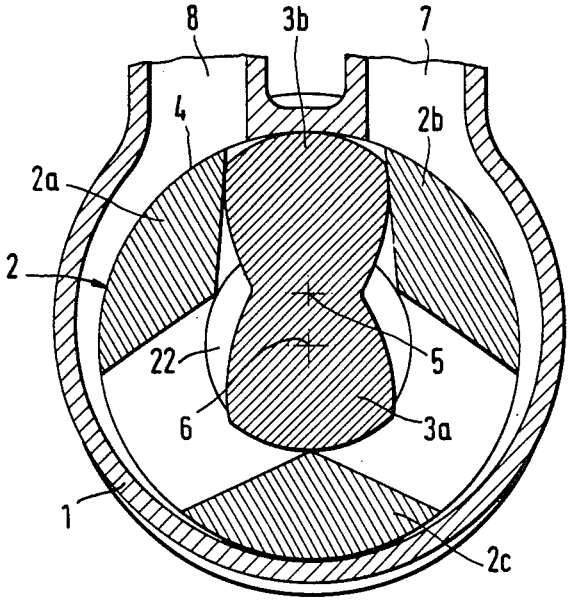
FIG. 2

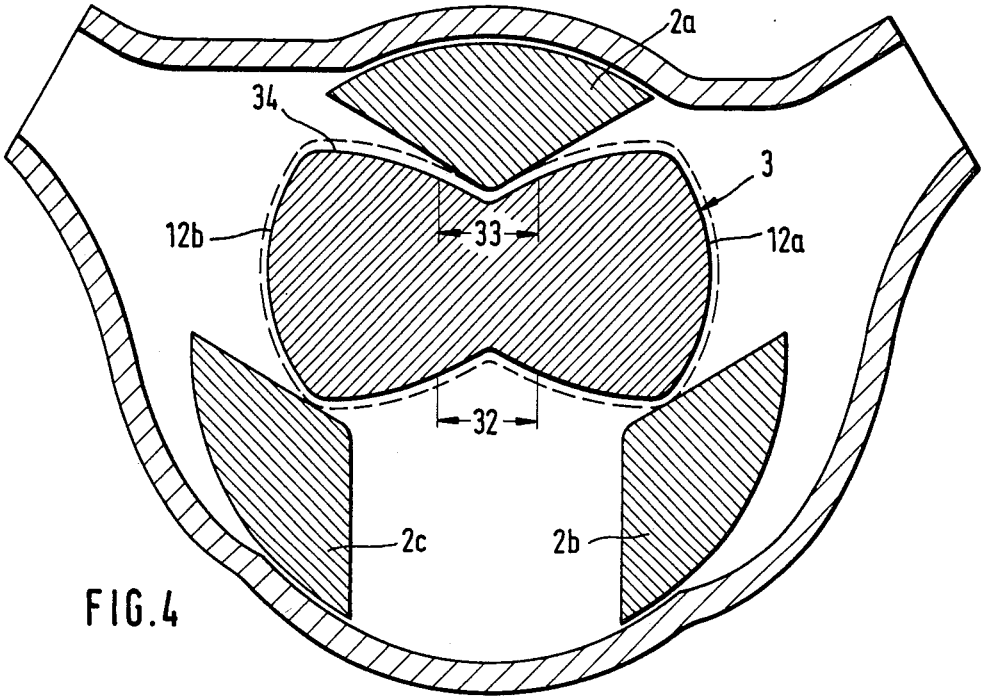
FIG.4
FIG.5
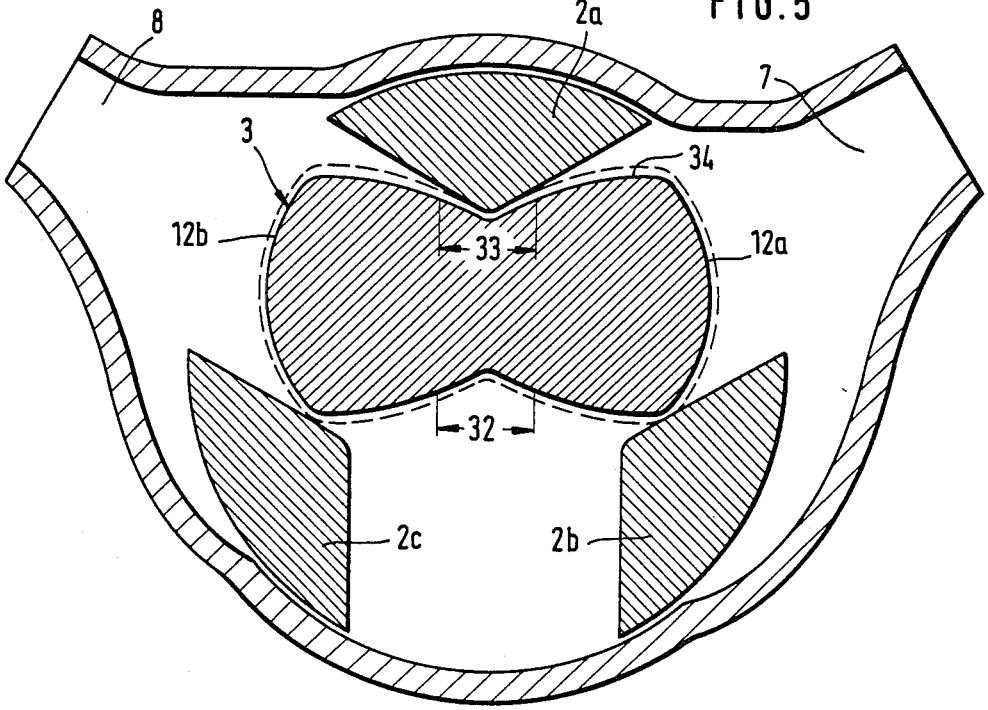

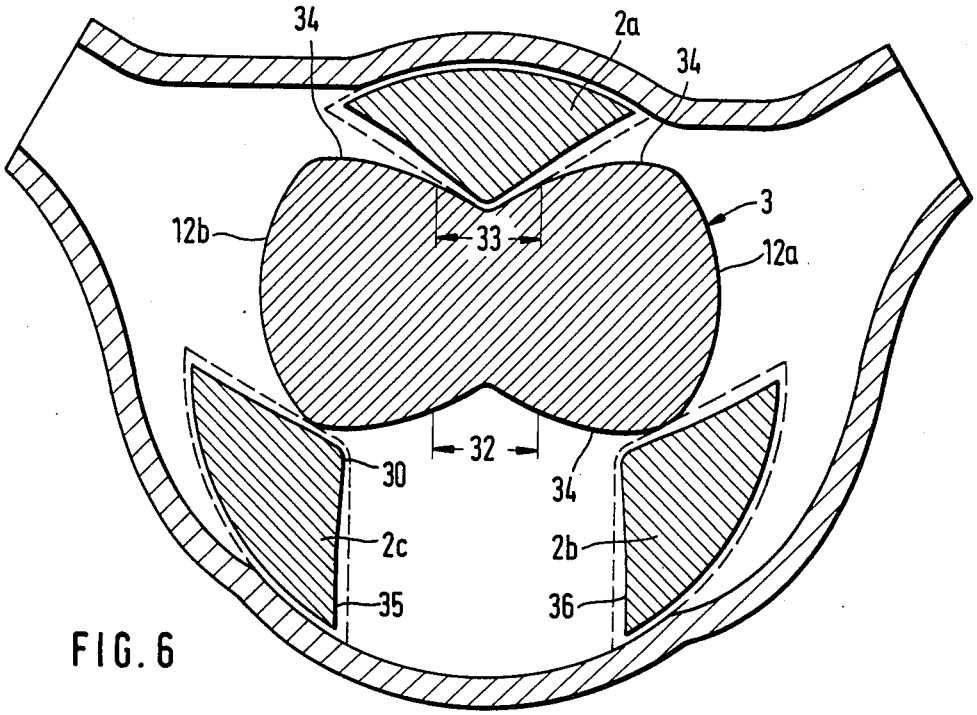
FIG. 6
FIG. 7
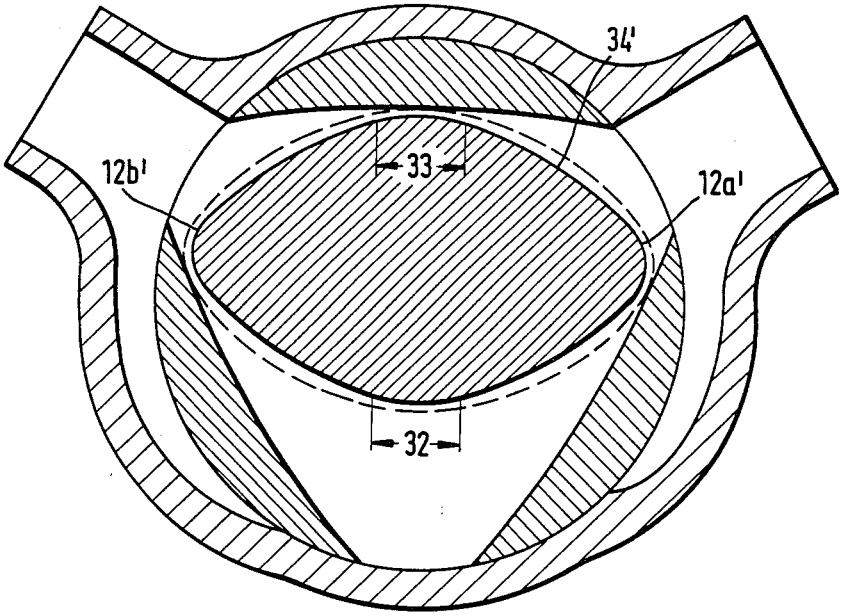

INTERNALLY AXED SINGLE-ROTATION MACHINE WITH SEALING GAP ARRANGEMENT

BACKGROUND OF THE INVENTION

The present invention relates to an improved construction of a single-rotation machine having internal axes with an external rotor and an internal rotor. These rotors are surrounded by a common casing circumferentially provided with an intake duct and an outlet duct, whereby as a result of the reciprocal engagement of the rotors they form working spaces with a variable volume sealed by sealing gap-forming rolling and/or sliding of alternating face regions of the rotors on one another and in which, based on its rotation axis, the internal rotor has radially inner circumferential surfaces, as well as transition surfaces between them.

In known machines of this type, the dimensioning of the sealing gaps between the two rotors constitutes an unsatisfactory compromise between the sealing losses and the frictional losses. Small sealing gaps, apart from correspondingly high frictional losses, also make high demands regarding the dimensionally correct manufacture and assembly.

SUMMARY OF THE INVENTION

Therefore, with the foregoing in mind, it is a primary object of the invention to improve this compromise on a machine of this type, in that an improved sealing effect is obtained between the machine rotors, in the case of relatively limited losses at the sealing gaps.

In order to implement this and still further objects of the invention, which will become more readily apparent as the description proceeds, the invention contemplates a machine of the aforementioned type and comprises additional sealing gaps between the two rotors which are smaller on the radially outer circumferential surfaces of the internal rotor than on its transition surfaces.

The improved compromise is based on the differing evaluation of the different surface regions of the internal rotor with respect to the sealing gap formation thereof, together with the external rotor, in order to seal the pressure side of the single-rotation machine from its low pressure side, both with respect to the shape of the sealing gaps or the surfaces forming the same and with respect to the significance of the local and time-based sealing gap position during the rotation of the rotors forming the sealing gaps.

BRIEF DESCRIPTION OF THE DRAWINGS

Advantageous embodiments of the invention are explained hereinafter relative to the drawings, wherein it is shown:

FIGS. 1 and 2 An axial and radial cross-section of an embodiment of a single-rotation machine having internal axis.

FIGS. 4 to 6 Embodiments of the invention on a machine corresponding to FIGS. 1 to 3;

FIG. 7 Another embodiment of the invention on another internally axed single-rotation machine.

Figures 3A, 3B, 3C, 3D, 3E, 3F, 3G, 3H, 3I, 3J, 3K, 3L:
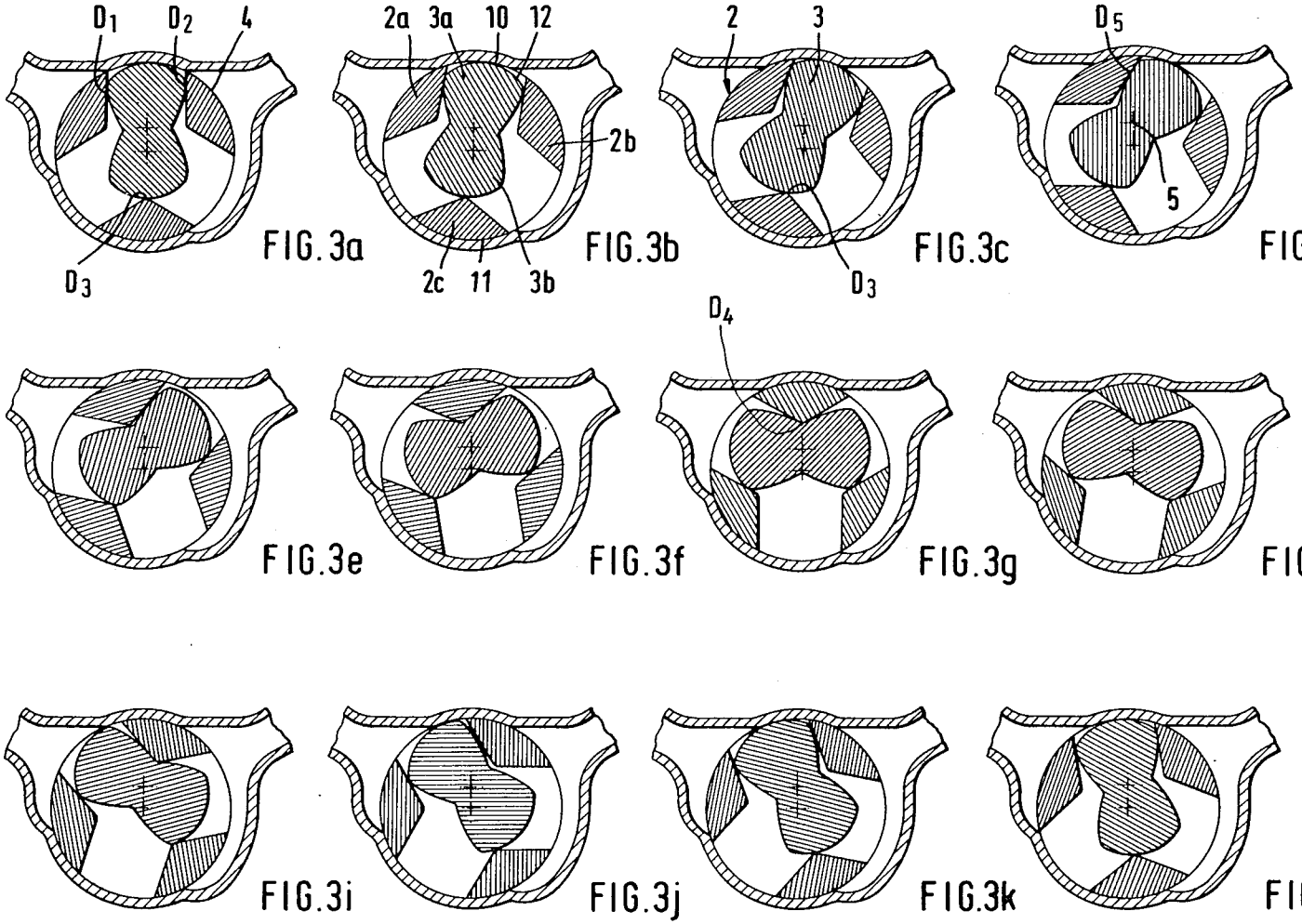
FIGS. 3*a* to 3*l* Rotation positions of the single-rotation machine according to FIGS. 1 and 2.

The embodiments shown in the drawings of single-rotation machines corresponding to FIGS. 1 to 6 and 7 are similar, because in both cases the speed ratio between external rotor 2 and internal rotor 3 is 2:3, with a corresponding ratio of the number of engagement parts 2*a*, 2*b*, 2*c* on the external rotor and internal rotor 3*a*, 3*b*.

However, the invention can be used in general terms on single-rotation machines having internal axes, e.g. also with a speed ratio of 4:3, 5:4, etc.

In accordance with the basic principle of single-rotation machines having internal axes, the outer circumference 4 of external rotor 2 surrounds axis 5 of internal rotor 3 which is fixed relative to machine casing 1 and the two axes 5, 6 of the two rotors 2, 3 are spaced from one another. The reciprocal arrangement of rotors 2, 3 or their axes 5, 6 is consequently comparable with those on a gear with an internally toothed spur gear.

In order to bring about the reciprocal sealing of the ducts provided on the circumference of casing 1, i.e. intake duct 7 and outlet duct 8 in the machine, the two rotors 2, 3 are in sealing gap-forming approximation to one another at several sealing points or regions $D_1$, $D_2$, $D_3$, $D_4$ $D_5$ etc. and along two facing circumferential regions 10, 11, the outer circumference 4 of engagement parts 2*a*, 2*b*, 2*c* of the external rotor and/or the outer circumference 12 of the engagement parts 3*a*, 3*b* of the internal rotor 2 are in sealing gap-forming approximation to the inner face of machine casing 1. This approximation or the width of said sealing gaps is approximately e.g. 0.05 to 0.1 mm, as a function of the manufacturing quality, or as a function of the intended use of the machine or density of the medium flowing through the machine.

It can be gathered from FIG. 1 that the circumferential faces of rotors 2, 3 and casing 1, which can form local or time-varying sealing gaps with one another are parallel to the also mutually parallel axes 5, 6 of rotors 2, 3. The journals 14, 15 of the internal rotor 3 are mounted by antifriction bearings 16, 17 on the lateral casing plates 1*a*, 1*b*, whilst the external rotor 2 with its hub-like, hollow axle journals 18, 19 is mounted on antifriction bearings 20, 21 on said casing side plates 1*a*, 1*b*, which surround the antifriction bearings 16, 17 of internal rotor 3. Stationary sealing plates 22, 23 fixed to the inside of the casing side plates 1*a*, 1*b* axially seal the working spaces of the machine formed between the two rotors 2, 3, so that the parallel lateral faces 24, 25 of the internal rotor 3 move in parallel along the sealing plates 22, 23 with a sealing gap-forming spacing. Although it is not fundamentally necessary due to the gear-like, reciprocal engagement between the two rotors, the latter are in driving connection via gears 26, 27, one of which is formed on the inside of the hub-like, hollow axle journal 19 by an internal tooth system. The gear 28 mounted on journal 15 of internal rotor 3 is for driving or to be driven, as a function of whether the machine is driven by a gas flow or delivers same as a compressor.

The operating principle, as well as the kinematic construction of the machine shown in FIGS. 1 to 3 are described in detail in the not previously published, earlier-dated patent application of DE-A-3 432 915.

FIGS. 4 to 7 show the width of the sealing gaps at the particular sealing points or regions $D_1$ to $D_5$ with local reference to the internal rotor (FIGS. 4, 5 and 7) for external rotor (FIG. 6) by broken lines and on a greatly increased scale, i.e. diagrammatically, in that said lines give the size of the internal or external rotor with respect to which the other rotor would not give a sealing gap. The actual width of the sealing gap for the narrowest sealing points which can be manufactured is e.g. 0.05 mm and at the widest sealing points which can be manufactured e.g. 0.1 mm.

According to the invention, in each case the smallest sealing gap is between a radially outer circumferential surface 12*a*, 12*b* of internal rotor 3 and an engagement part 2*a*, 12*b*, 2*c* of the external rotor, such an occurs at points $D_3$ or in FIGS. 3*a* to 3*f* and FIGS. 3*i* to 3*l*. This is indicated by the broken lines in the embodiments of FIGS. 4 and 5 which have limited spacing from the circumferential surfaces 12*a*, 12*b*, as well as at the circumferential surfaces 12*a'*, 12*b'* of the embodiment of FIG. 7. In the embodiment of FIG. 6, the smallest sealing gap is obtained at the same engagement points $D_3$ between rotors 2, 3 by correspondingly smaller dimensioning of the engagement parts 2*a*, 2*b*, 2*c*, as is indicated by the continuous contour line compared with the broken contour line of said engagement parts. Thus, in the radially inner corner regions 30, the spacing between the theoretical broken contour line and the continuous contour line is smallest. Instead of correspondingly smaller dimensioning, i.e. taking account of a sealing gap on the internal rotor (FIGS. 4, 5 and 7) or only on the external rotor (FIG. 6), is not snown manner there can be a corresponding underdimensioning with respect to the theoretical sealing gap-free contour on both rotors 2, 3.

The choice of small sealing gaps on the outer circumference of the internal rotor 3 is substantiated by the greater significance of a good sealing in this region corresponding to the rotation positions of FIGS. 3*a* to 3*f* and FIGS. 3*i* to 3*l*, because in this rotation position the low and high pressure sides of the machine are only separated from one another by a sealing gap $D_3$ and in view of the short approximation zone between the faces of both rotors in the circumferential direction said sealing gap $D_3$ has a relatively poor sealing action.

The sealing gaps $D_4$ occurring during the rotation of the rotors between the same in the vicinity of the radially inner circumferential surfaces 32, 33 of internal rotor 3 admittedly also only have to separate the low and high pressure sides of the machine from one another, but it is possible there to accept wider sealing gaps $D_4$ for reducing frictional losses, because in this region the faces of both rotors 2, 3 adjacent to the sealing gap are at a limited distance from one another and therefore contribute to the sealing effect or circumferentially widen the sealing gap. Larger or wider sealing gaps on the radially inner circumferential surfaces 32, 33 lead to the further advantage of reducing losses by compression flows, particularly if the machine is intended for high rotation speeds of e.g. more than 20 000 r.p.m.—a corresponding example being shown in FIG. 4.

However, if the machine is mainly intended for relatively low rotation speeds and low density gases, then preferably narrower sealing gaps $D_4$ are also provided on the radially inner circumferential surfaces 32, 33 of the internal rotor in order to obtain a good sealing action and as shown in the embodiment of FIG. 5.

In the region of the transition surfaces 34 located between the radially outer circumferential surfaces 12*a*, 12*b* and the radially inner circumferential surfaces 32, 33, in each embodiment according to the invention, the sealing gaps occurring with respect to the inner faces 35, 36 of the engagement parts 2*a*, 2*b*, 2*c* are wider than in the region of the radially outer circumferential surfaces 12*a*, 12*b*, so that the frictional losses occurring there are correspondingly low. This is possible without any significant sealing losses, because these sealing gaps $D_1$, $D_2$, according to the representations of the rotation positions in FIGS. 3*a* to 3*l*, only occur if the radially outer circumferential surfaces 12*a*, 12*b* are very close to the circumferential regions 10, 11 of the casing inner face, so that they are not solely responsible for sealing the low pressure side from the high pressure side of the machine. There is in any case a better sealing action on these transition surfaces due to their tooth flank-like engagement with the inner faces 35, 36 and the corresponding flatter sealing gap-forming surfaces in the direction of the pressure gradient.

Due to the engagement positions in the case of sealing gap formation on the transition surfaces 34 in the manner described hereinbefore, the width of the sealing gap $D_1$, $D_2$ is advantageously made increasingly larger, corresponding to its distance from the internal rotor axis 5, as shown in FIGS. 5 and 6, so that the undersize to be provided for the corresponding sealing gap widths on the internal or external rotor increases radially outwards.

What is claimed is:

1. A single-rotation machine having internal axes comprising:

a casing defining an internal volume, said volume defining two facing circumferential regions, said casing having an intake and an outlet for allowing flow through said intake into said volume and out of said outlet;

an internal rotor having n engagement parts and an external rotor having n+1 engagement parts, each of said rotors being mounted about a respective central axis for rotation within said casing, said axes being spaced from each other and fixed relative to said casing, said rotors rotating at different angular velocities according to the ratio of n+1 to n;

said engagement parts of said internal rotor having an outer circumference, radially inner circumferential surfaces, and transition surfaces between said radially inner circumferential surfaces and said outer circumference;

said engagement parts of said external rotor each having a radially inner corner region and an outer circumference joined to said radially inner corner region, said outer circumferences moving in sealing gap forming relationship past said two facing circumferential regions of said casing, said radially inner corner regions moving in sealing gap forming relationship past said transition surfaces and said radially inner circumferential surfaces;

said outer circumferences of said engagement parts of said internal rotor moving past said radially inner corner regions of said external rotor in sealing gap forming relationship, whereby as a result of the continuous reciprocal engagement of said rotors variable volumed work spaces are formed sealed by sealing gap forming movement of said rotors past one another, the sealing gaps between said two rotors being of lesser volume when formed on said outer circumference of said engagement parts of said internal rotor than when formed on said transition surface of said internal rotor.

2. The machine of claim 1 wherein said sealing gaps formed with said outer circumference of said internal rotor are smaller than those formed on said radially inner circumferential surfaces of said internal rotor.

3. The machine of claim 1 wherein said sealing gaps formed on said radially inner circumferential surfaces of said internal rotor are smaller than said sealing gaps formed on said transition surfaces of said internal rotor.

4. The machine according to claim 1 wherein in the radially outward direction of said internal rotor said sealing gaps occurring on said transition surfaces of said internal rotor have an increasing width.

5. The machine according to claim 1 wherein said sealing gaps formed on at least one of said rotors are uncharacteristically small when compared with the kinematically generated sealing gap free shape of said rotors.

6. The machine of claim 2 wherein said sealings gaps occurring on said radially inner circumferential surfaces of said internal rotor are smaller than said sealing gaps formed on said transition surfaces of said internal rotor.

7. The machine of claim 6 wherein in the radially outward direction of said internal rotor said sealing gaps formed on said transition surfaces of said internal rotor have an increasing width.

* * * * *